US006981551B2

(12) United States Patent
Turner et al.

(10) Patent No.: US 6,981,551 B2
(45) Date of Patent: Jan. 3, 2006

(54) CROSS-OVER TOOL RETURN PORT COVER

(75) Inventors: Dewayne M. Turner, Tomball, TX (US); Marvin Bryce Traweek, Houston, TX (US); Christopher L. Blackler, Spring, TX (US); Stephen C. Yeary, Houston, TX (US); Gregg W. Stout, Montgomery, TX (US)

(73) Assignee: BJ Services Company, Houston, TX (US)

( * ) Notice: Subject to any disclaimer, the term of this patent is extended or adjusted under 35 U.S.C. 154(b) by 123 days.

(21) Appl. No.: 10/614,500

(22) Filed: Jul. 7, 2003

(65) Prior Publication Data

US 2005/0006092 A1 Jan. 13, 2005

(51) Int. Cl.
*E21B 43/04* (2006.01)

(52) U.S. Cl. ..... 166/278; 166/51; 166/334.4

(58) Field of Classification Search ..... 166/278, 166/51, 332.5, 334.4
See application file for complete search history.

(56) References Cited

U.S. PATENT DOCUMENTS

| | | | | |
|---|---|---|---|---|
| 4,428,428 | A * | 1/1984 | Smyrl et al. | 166/278 |
| 5,597,040 | A | 1/1997 | Stout et al. | |
| 5,609,204 | A | 3/1997 | Rebardi et al. | |
| 5,676,208 | A * | 10/1997 | Finley | 166/278 |
| 6,397,949 | B1 | 6/2002 | Walker et al. | |
| 2003/0019634 | A1 * | 1/2003 | Henderson et al. | 166/373 |
| 2003/0192694 | A1 * | 10/2003 | Zachman et al. | 166/278 |

* cited by examiner

*Primary Examiner*—William Neuder
(74) *Attorney, Agent, or Firm*—Locke Liddell & Sapp LLP

(57) ABSTRACT

The present invention provides a return port cover that can close and open a return port separate from tubing movement caused by stretching or contracting under stress or other induced pipe movement from downhole conditions. For example, the return port cover can assist in preventing pack "fluffing" by preventing unintended fluid communication through an associated downhole tool regardless of the position of a circulating valve means. The return port cover can be biased, so that in one position it closes the port and in another position opens the port based on relative tubing placement at different portions of the fracturing operation or other well treatment operations.

29 Claims, 4 Drawing Sheets

10
14A
17
18
108
110
112
94
90
102
104
20
22
36a
106
28
100
97
98
96
88
92
26

17
104
28
102
90
92
96
12
15
26
94

CROSS-OVER TOOL RETURN PORT COVER

FIELD OF THE INVENTION

This invention relates to the field of subsurface tools used in hydrocarbon wells. More particularly, the invention relates to cross-over tools.

BACKGROUND OF THE INVENTION

Hydrocarbon wells such as oil and gas wells frequently need fracturing of the strata to adequately produce hydrocarbons from the strata. Fracturing cracks the strata to allow more surface area to flow the hydrocarbons. Fracturing generally occurs after the well has been drilled, casing has been placed, and various completion tools inserted into the well bore. Proppant through a flowable slurry is filled in the cracks to maintain the cracks in an open position. A screen is typically placed in the well bore to allow hydrocarbons to flow into a production tubing and up to the well surface without allowing the proppant and sand from the strata to flow into the tubing.

The typical techniques involved in flowing proppant are to flow it through a central flow path in a tubing string disposed in the casing and divert it to an annulus formed between a completion assembly, attached to the tubing string, and the casing to fill the annulus in the region of the screen. Then, the flow path is reversed to wash out excess proppant remaining in the tubing string and a cross-over tool.

To accomplish the flow reversal, the cross-over tool is frequently used by attaching it to the tubing string above the screen region. The cross-over tool is positioned in the completion assembly so that the slurry is initially diverted from the central flow path of the tubing string into the annulus around the screen and into the formation. The flow reversal can occur by repositioning the cross-over tool to the reverse position to create a flow path down an upper portion of the annulus and back up the central flow path of the tubing string.

A problem has been realized in the flow reversal. The frac pressures used to treat the well can actually stretch or contract the tubing string, known as tubing movement. Tubing movement can occur by temperature changes, piston effects, ballooning effects, buoyancy effects, and other downhole conditions. A typical length of several thousand feet of tubing that is often placed in the well bore can change length based on the above factors. The tubing movement length change can cause misalignment of the tool structures and inadvertently open and close ports that are not intended. Inadvertently open flow ports can cause the proppant placed in the fracturing operation to become displaced and create other disadvantageous results.

For example, if the cross-over tool is in the reverse position, a so-called circulating valve needs to remain closed. If the valve opens, reverse fluid can travel through the circulating valve, out a wash pipe in the completion string, through the screen, and into the frac pack. Fluid movement upward through the pack tends to "fluff" the pack, thus, destroying the integrity of the pack by creating voids. This upward flow can also carry sand or proppant back into the tool assembly, creating other problems. Stated differently, the circulating valve, or in some cases, a reversing ball, must not open while reversing. But if tubing movement enables fluid communication, then "fluffing" can occur.

Other problems can also occur from inadvertent opening and closing, such as loss of fluids or misdirected fluids at inappropriate times, and so forth. Further, tubing movement exists with other procedures, such as gravel packing, acidizing, water packing, and other well treatments and can also cause problems.

Therefore, there remains a need to increase the reliability of the fracturing operation and other well treatment operations.

SUMMARY OF THE INVENTION

The present invention provides a return port cover that can close and open a return port separate from tubing movement caused by stretching or contracting under stress or other induced pipe movement from downhole conditions. For example, the return port cover can assist in preventing pack "fluffing" by preventing unintended fluid communication through an associated downhole tool regardless of the position of a circulating valve means. The return port cover can be biased, so that in one position it closes the port and in another position opens the port based on relative tubing placement at different portions of the fracturing operation or other well treatment operations.

The present invention provides a method of controlling flow through a return port positioned downhole in a well, comprising providing an engagement surface on a downhole member disposed downhole in the well; engaging a downhole well treatment tool having a return port cover coupled thereto with the engagement surface of the downhole member to move the return port cover from a first position to a second position; disengaging the well treatment tool from the engagement surface of the downhole member; and allowing the return port cover to move from the second position.

The present invention also provides a well treatment tool, comprising a wall having a return port formed therethrough to establish a fluid flow path between an exterior portion and an interior portion of the well treatment tool; a return port cover coupled to the wall proximal the return port, the return port cover having a first position and a second position, wherein one position comprises an at least partially closed position on the return port and the other position comprises an at least partially open position on the return port; an engagement surface coupled to the return port cover and adapted to engage another engagement surface disposed downhole and independent from the well treatment tool for actuation of the return port cover.

The invention further provides a system for controlling flow through a port, comprising a well treatment tool having a return port and a means for at least partially opening and closing the return port at selective times in a well treatment operation.

BRIEF DESCRIPTION OF THE DRAWINGS

A more particular description of the invention, briefly summarized above, can be realized by reference to the embodiments thereof that are illustrated in the appended drawings and described herein. However, it is to be noted that the appended drawings illustrate only some embodiments of the invention. Therefore, the drawings are not to be considered limiting of its scope, for the invention may admit to other equally effective embodiments.

DETAILED DESCRIPTION OF THE INVENTION

Figure 1:
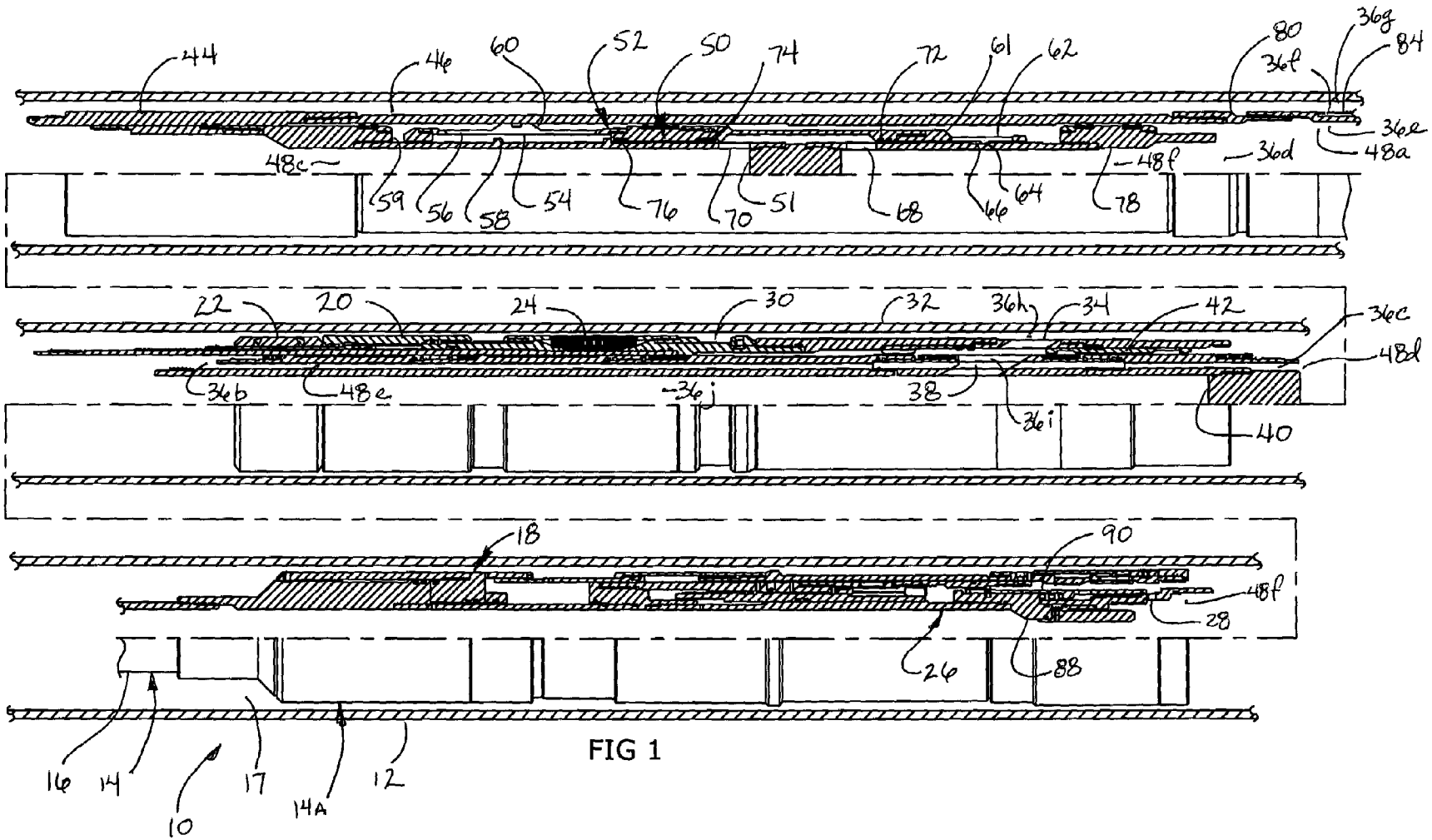
FIG. 1 is a schematic cross-sectional side view of a portion of a tool string in an initial "run in" position.

FIG. 1 is a schematic cross-sectional side view of a portion of a tool string in an initial "run in" position. A well bore 10 is established in various strata of the earth, whether on land or subsea. A casing 12 is generally placed in the well bore, although a casingless well can be formed in some strata. A work string 14 is used to carry a series of tools, known as a "tool string," into the well and position the tool string at the correct location. Generally, the work string can include several thousand feet of drill pipe or tubing, depending on the depth of the well bore and location of production zones. The work string 14 establishes a central flow path 15 through the bore of the work string and an annular flow path 17 between the work string and the casing 12. Each flow path is used at various stages of the well treatment process.

Generally, a completion work string can be used to suspend various downhole tools to form a tool string 14A used to complete the preparation of the well prior to production. A tool string 14A is a general term describing a plurality of downhole tools and sections mounted to the work string 14 for performing various operations from drilling to completing the well to producing the well. A work string may be run initially or at a later time and allow subsequent maintenance operations. Completion string tools can be used to perforate the casing to allow production fluids to flow into the casing, set various packers at appropriate depths, frac or gravel pack appropriate areas, and other well treatment operations. The completion work string is removed with various tools, such as packers being left in the well bore, and a production work string is set in the hole for production of the fluids to the surface. In some operations, the completion work string and production work string are combined, so that reduced trips into the well bore are possible. For the purposes herein, the term "work string" is meant to at least include any string of pipe, tubing, or wireline used to suspend tools used for completing a well or other well treatments, including pre-production and post-production well treatments.

The tool string 14A described herein is representative of an assembly that can be used with the present invention, but is not limiting of the invention because the invention can be used with a variety of tool assemblies. For the purposes of illustration, the tool string described below includes a setting tool 18, a packer 20, a cross-over tool 26, a multi-service sliding sleeve 32, a polished bore receptacle ("PBR") 44, another casing spacer 46, a circulating valve means 50, a cross-over reducer 80, and a screen 84. Each of the various tools with their subparts are described below as appropriate.

A setting tool 18 is shown coupled to the work string 14. The term "coupled," "coupling," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include integrally forming one functional member with another. The coupling can occur in any direction, including rotationally. Often, the setting tool is hydraulically actuated by pressurizing the central flow path 15 with fluid, so that various pistons and other devices move to actuate other assemblies.

A packer 20 is selectively coupled to the setting tool 18. The packer can be hydraulically actuated in conjunction with a hydraulic setting tool or it can be mechanically actuated by movement of the assemblies in the well bore or a combination thereof. A flexible packing element 22 is radially extended to sealingly engage the walls of the casing 12. The extension of the packing element can be controlled with the movement of the setting tool and various subassemblies. One or more slips 24 are used to assist the packer in retaining its placement at an appropriate depth by expanding and gripping the walls of the casing.

Frequently, the packer is set and released from the setting tool and left in the well bore. The packer can be coupled to other tools described herein that become fixedly positioned when the packer is set. Still other tools can be moved longitudinally or rotationally relative to the fixedly positioned tools, such as when completing the well prior to production. One such tool, a cross-over tool 26, is moved to change flow paths in the well in conjunction with some of the fixedly positioned tools. Other well treatment tools having various flow paths can also be used.

The cross-over tool 26 can be coupled to the work string 14 and selectively coupled to the packer 20 through the setting tool 18. The cross-over tool 26 can form a significant piece of the tool string when changes are needed in the flow paths to perform various operations in the well. The cross-over tool 28 includes several subsections and openings in one or more walls of the cross-over tool that move relative to each other to control the various flow paths, described below.

One such subsection and opening includes a return port 28 formed in a wall of the cross-over tool and a cross-over tool return port cover 90 disposed adjacent and proximal to the return port. The return port 28 is useful for returning flow to the surface between an interior portion and an exterior portion of the cross-over tool and can also provide pressure monitoring during the fracturing or other well treatment processes. However, the tubing movement described above caused by pressure stretching of the work string allows the return port and other ports below the return port to unintentionally be opened or closed at unintended times. This unintended opening or closing can damage the placement of the proppant in the fracturing process and cause other challenges.

A solution provided by the present invention is to use and provide a return port cover 90, so that it opens on engagement with a known surface and closes at other times. Further, it is operational in the proximal area of the return port 28. The known engagement surface can unintentionally move by tubing movement described above. However, the work string and the return port cover coupled thereto can be adjusted independently of the tubing movement, so that the return port cover engages and disengages the engagement surface at wherever the engagement surface has been displaced. Thus, the opening and closing of the return port can be controlled. The tubing movement has little ultimate effect on the ability to open and close the port 28, because the return port cover 90 in a broad sense does not depend on a constant positioning with other tools for proper operation. Further details of the return port cover 90 are provided in FIGS. 2 and 3.

The cross-over tool 26 also includes a frac port 38, through which proppant and other fluids can flow when aligned with other openings. The tool string 14A can move the cross-over tool 26 longitudinally and/or rotationally relative to other tools and openings to create the changes in flow paths. Seals above and below the frac port 38 assist in directing flow to the window 34.

A passageway sealing surface 40 is used to seal the central flow path 15, often in cooperation with a dropped ball or other movable object, so that flow is directed through the upstream frac port 38 and window 34. Frequently, the central flow path 15 is pressurized by using the passageway sealing surface 40 at selected times to cause various tooling assemblies to shift or move as described herein.

A circulating valve means 50 can be coupled to the cross-over tool 26. The circulating valve means 50 is sometimes referred to as a "shifting tool," because it can be used to move other tools to shifted positions. The circulating valve means can also be used to replace the traditional reversing ball in the cross-over tool. The circulating valve means advantageously allows the monitoring of pressure on the annulus while fracing the well, in contrast to the reversing ball. However, in some embodiments, where the monitoring is secondary, the reversing ball can be used.

The circulating valve means 50 includes a passageway sealing surface 51 to restrict flow in the central flow path 15 for the various shifting operations using the circulating valve means, as would be known to those with ordinary skill in the art. The circulating valve means 50 also includes a collet assembly 52 having a collet head 54 and a detent collet 61. The collet head 54 includes at least one collet finger 56 that is generally biased radially outward to engage other tools as it is moved longitudinally in the well. The movement of the collet finger 56 is limited between a stroke tab 58 and a corresponding shoulder 59. The collet finger 56 can also include a shifting tab 60 to assist in engaging and shifting other tools as the collet assembly 52 is moved longitudinally. The detent collet 61 can also include at least one collet finger 62 with a detent tab 64. The collet finger 64 can be biased inwardly to engage a detent 66 formed in the circulating valve means 50 to assist in maintaining a shifted position of the collet assembly 52.

Figure 5:
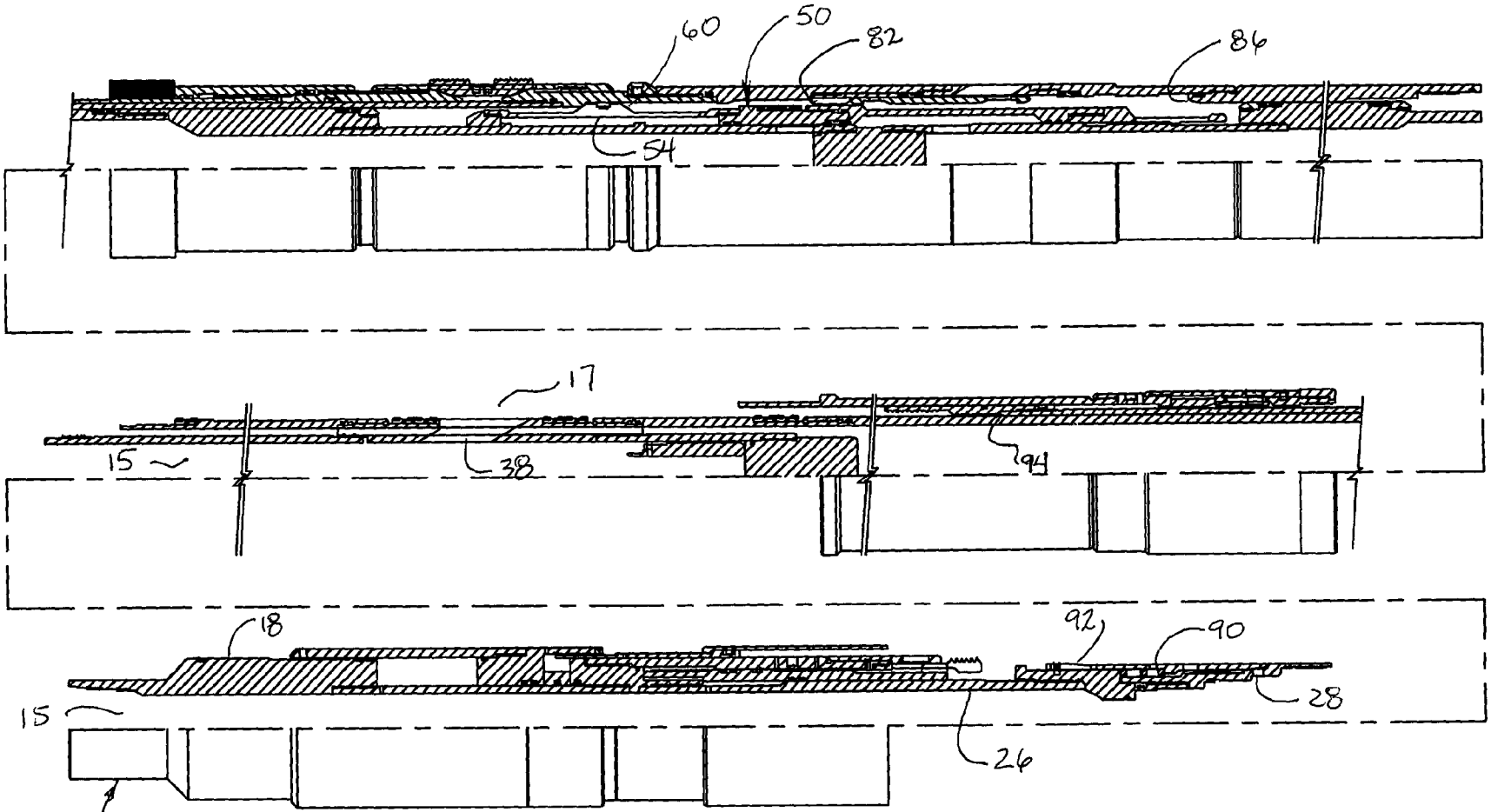
FIG. 5 is a schematic cross-sectional side view of a portion of a tool string in a "reverse" position.

In some embodiments, the circulating valve means 50 can also include at least two circulation ports 68, 70 for flowing fluids through the valve around the passageway sealing surface 51. The ports can be selectively opened and closed by location of the collet assembly 52. The collet assembly 52 can include circulation seals 72, 74, 76 to assist in restricting the flow through the ports 68, 70. The circulation seal 74 can be selectively disposed between the ports 68, 70, as shown in FIG. 5, so that any flow is restricted therethrough and flow is restricted outside of the collet assembly by the two circulation seals 72, 76 to the sides of the circulation seal 74, respectively.

A sealing member 78 having at least one seal can be coupled to the circulating valve means 50. The sealing member 78 is used to selectively engage various portions of the tools, such as the PBR 44, as selected times in the operations to control flow below or above the sealing member 78.

The tool string 14A can further include a multi-service sliding sleeve ("MS sliding sleeve") 32 coupled to the packer 20 through a casing spacer 30. A casing spacer can be of variable length depending on the needs of the particular assembly of tools and well. The MS sliding sleeve 32 is generally mounted external to the cross-over tool 26. The MS sliding sleeve 32 is used to isolate the zone after the flow of proppant slurry through a window 34. As shown, the window 34 can be, but not required, initially aligned with the frac port 38 in the cross-over tool as a "run in" position.

The MS sliding sleeve 32 generally includes a window 34 that communicates with other openings, such as the frac port 38 in the cross-over tool 26, for flow therethrough. Seals to either side of the window 34 assist in restricting undesired flow.

A sliding sleeve 42 of the MS sliding sleeve 32 is used to slide over the window 34 to restrict flow from other ports even when the frac port 38 of the cross-over tool is not aligned with the window. The sliding sleeve 42 functions in conjunction with the collet assembly 52, described below.

The PBR 44 can be coupled to the MS sliding sleeve 32. The PBR 44 has an internal smooth bore that is used as a sealing surface for various portions of the cross-over tool and other tools with seals as the tools move longitudinally in the well. The PBR 44 provides a sealing surface to restrict unintended flow at portions of the well process, such as in conjunction with the cross-over tool 26 that is moved internally thereto.

A casing spacer 46 can be coupled to the PBR 44 to allow for appropriate spacing between components. The length and use is known to those with ordinary skill in the art and depends on the relative length of the particular tools in the work string and other known factors.

A cross-over reducer 80 can be coupled to the casing spacer 46 to reduce the diameter of the completion assembly and serve as a coupler to a screen 84. The screen 84 can be coupled to the completion assembly below the cross-over tool 28. The screen allows production fluids from the formation into the central flow path 15 while restraining the entrance of the proppant and particles from strata, once the cross-over tool is moved and production tubing and seal assembly is positioned for well production. Other assemblies not shown include a lower packer also known as a "sump packer" for restricting fluid flow past the packer.

Having described the general assembly and various portions in the tool string 14A, further attention is directed to the return port cover 90.

Figures 2, 3:
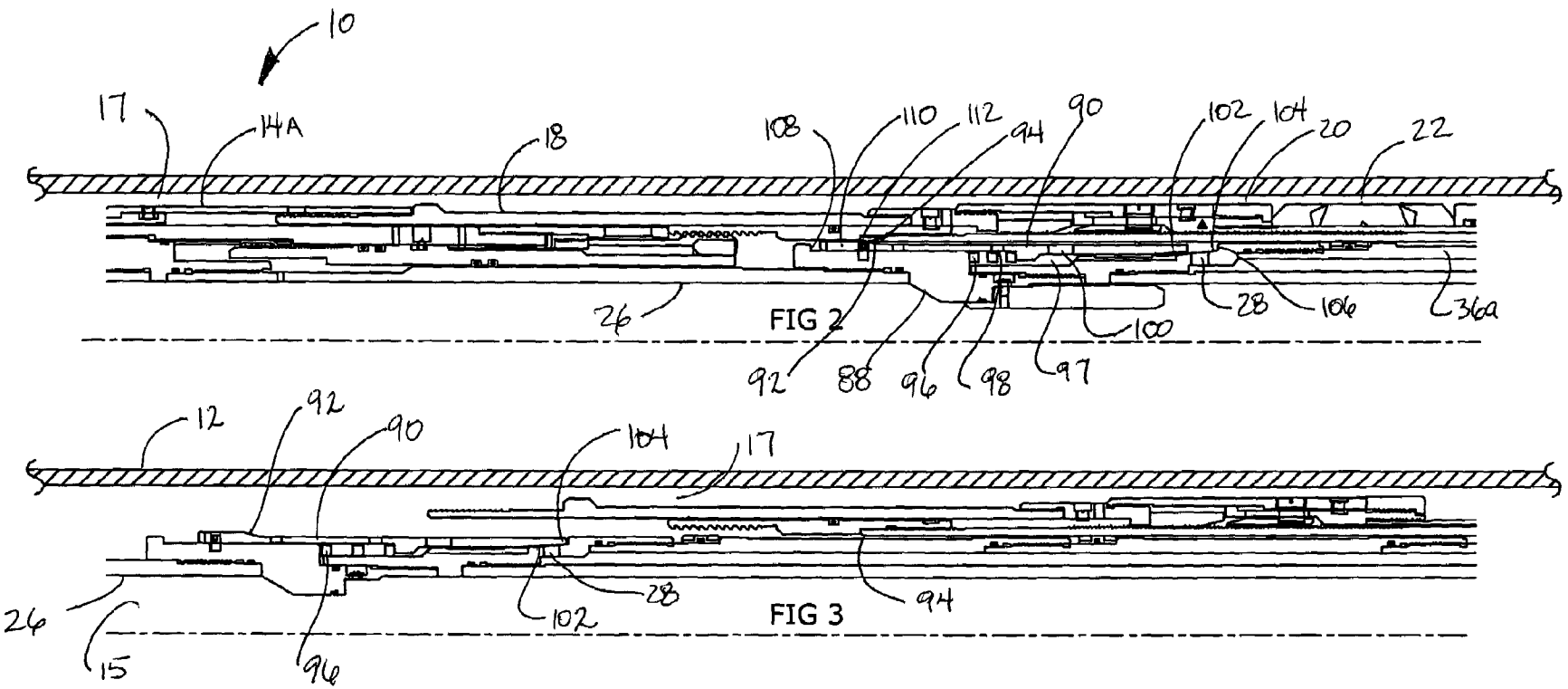
FIG. 2 is a schematic cross-sectional side view of a return port cover in an at least partially opened position on a return port and associated elements.
FIG. 3 is a schematic cross-sectional side view a return port cover in an at least partially closed position on the return port and associated elements.

FIGS. 2 and 3 are schematic cross sectional views of details of the return port 28, the return port cover 90, and surrounding elements. FIG. 2 is a schematic cross-sectional side view of a return port cover 90 in an at least partially opened position on a return port 28. FIG. 3 is a schematic cross-sectional side view a return port cover 90 in an at least partially closed position on the return port 28. FIGS. 2 and 3 will be described in conjunction with each other. In general, the work string 14 with a central flow path 15 can be coupled to a setting tool 18, as described above. The setting tool can be coupled to a packer 20 having a packing element 22. A cross-over tool 26 can be releasably coupled to the packer 20, generally near to the top of the packer. The cross-over tool 26 includes a return port 28 for fluid flow therethrough. The return port 28 can be formed as a return port subsection 88 of the cross-over tool 26.

The return port cover 90 is generally mounted external relative to the return port 26 so that external surfaces and/or devices can actuate the cover. For example, the return port cover includes an engagement surface 92, such as a shoulder in this embodiment, another protrusion or a recess. Other engagement surfaces on the return port cover could be used. The engagement surface 92 can be sized to interact with an engagement surface 94, such as a shoulder, formed on the packer 20. The engagement surface 94 is advantageously formed on or otherwise coupled to an uphole portion of the packer 20 to allow the return port cover 90 to be raised and lowered with minimal interference with other tooling in the well bore. Other surfaces could be used on the packer and other downhole members. A bias element 96, such as a spring, can be used to bias the return port cover. The bias element 96 can be housed in a recess 97 formed in the return port subsection 88. One or more openings 98, 100 can also be formed in the return port cover that can assist in washing out debris.

On the portion of the cover that engages the return port, the cover can be formed with a return port cover taper 102. The taper 102 can engage a corresponding taper 104 formed on the return port area. Thus, as the return port cover 90 covers the return port 28, the tapers 102 and 104 matingly engage to restrict flow though the return port. The tapers' engagement serves to restrict the travel of the return port cover. In unusual circumstances, a stop 106 formed on the return port subsection can be used to stop the return port cover if the tapers do not engage prior thereto. Similarly, a shoulder 108 formed on the other end of the return port subsection limits the reverse travel of the return port cover 90. Further, seals could be used as necessary or desired.

A slot 110 is formed in the return port cover 90 to further restrict the available travel of the port cover. The slot 110 can work in conjunction with a travel stop 112, such as a setscrew, bolt, pin, or other device mounted within the slot 110.

The return port cover 90 functions with the engagement surface 94 generally when one or more of the frac packing procedures are being performed. The cross-over tool 26 can be positioned, so that the return port cover 90 being engaged with the engagement surface 94 uncovers and thereby at least partially opens the return port 28 as shown in FIG. 2. At other times in the procedures, the cross-over tool 26 can be relocated, for example uphole as shown in FIG. 3, so that the return port cover 90 does not engage the engagement surface 94 and the return port cover is allowed to cover and thereby at least partially close the return port 28. In this embodiment, the return port cover 90 is biased closed over the return port 28 when the return port cover is not engaged with the engagement surface 94.

One advantage of using the engagement surface 94 is that it is located in the packer as one of the most upward engagement surfaces, as in FIG. 2. This position generally assures that the port cover is open and flow can occur through port 28 when the tool is in the circulating or frac position. An open port 28 allows monitoring of the frac pressure in the upper annulus during pumping operations, i.e., mini-fracing or fracing with proppant.

FIG. 3 shows the tool moved to the reverse position. As surface 92 disengages from surface 94, the spring 96 at least partially closes the return port cover 90 over port 28 to restrict fluid movement. For example, in the embodiment shown, the flow would be restricted inward toward annular spaces or other flow paths 36*a*, 36*b*, 36*c*, 36*d*, and 36*e*, outside the screen 36*f*, through gravel pack 36*g*, back up through flow path 36*h* at the window 34, and into flow paths 36*i* and 36*j*. This flow path is one example of a flow path that can "fluff" the pack, described above. However, the closure of the return port cover 90 with the return port stops or otherwise restricts this flow.

Thus, the cross-over tool 26 can be moved away from the engagement surface 94 in the well bore and not interfere with the operation of the return port cover 90. Further, the return port cover 90 is coupled and controlled in proximity to the return port 28. Thus, tubing stretch caused by pressures or other downhole conditions on the tubing has little, if any, effect on the ability of the return port cover 90 to at least partially close and open the return port 28.

Returning to FIG. 1, the cross-over tool 26 can be "run in" to the well bore in an open position so that the frac port 38 of the cross-over tool 26 is aligned or communicating with the window 34 of the MS sliding sleeve 32. This alignment allows for subsequent flow through various openings in a "circulating" position to follow the "run in" position. Further, the sliding sleeve 42 of the MS sliding sleeve 32 is open to allow the window to receive flow from the frac port 38. For simplicity, an initially open position will be described with the understanding that a closed position could be the initial position.

The work string 14 with the tool string 14A coupled thereto is run into the well bore. The packer 20 with the flexible packing element 22 is not "set" in position against the casing wall, so that a clearance is formed between the packing element and the casing 12 through which the packer is longitudinally run. The tool string is placed at an appropriate depth and the packer is set. In one embodiment, the setting tool is pressurized through fluid in the central flow path 15. The pressure actuates various internal elements to force the packing element 22 radially outward in the annulus 17 to engage the casing 12. The tools fixedly coupled to the packer 20 are thus also set in position. While the work string with the setting tool 18 and cross-over tool 26 also releases the packer 20 and tools coupled thereto for independent movement, the work string can leave the cross-over tool 26 and various tools in that relative position for the next position, known as a "circulating" or frac position.

The return port cover 90 is in a retracted state by engagement of the engagement surface 92 on the port cover with the engagement surface 94 on the packer 20, described above. Thus, the return port 28 is open to allow flow therethrough.

Further, the collet assembly 52 is located in a position that restricts flow through the circulation ports 68, 70. The circulation seal 74 is positioned between the ports 68, 70 with the seals 72, 76 located to both sides of the seal 74 and the ports, respectively.

Figure 4:
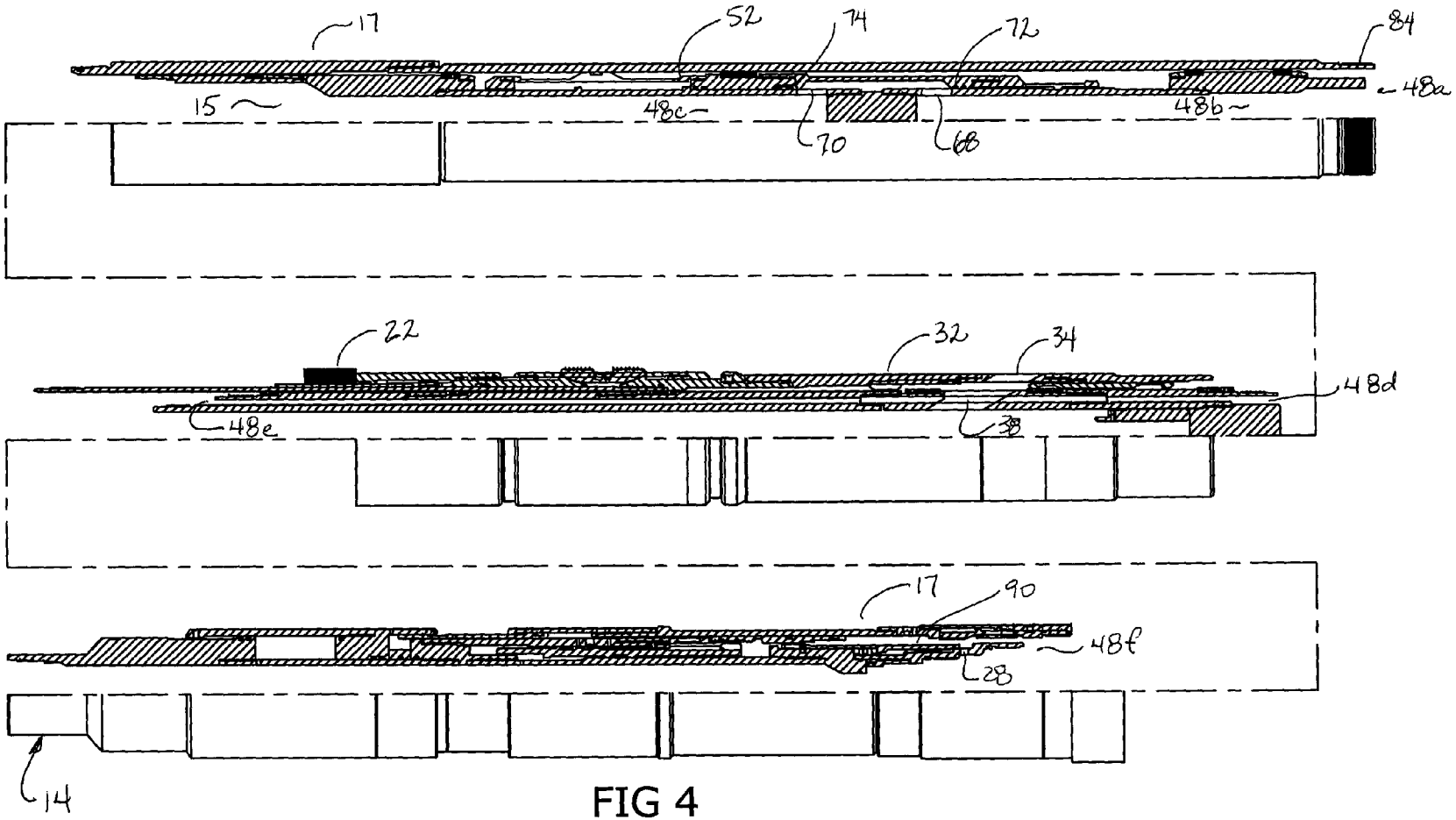
FIG. 4 is a schematic cross-sectional side view of a portion of a tool string in a "circulation" position.

FIG. 4 is a schematic cross-sectional side view of a portion of a tool string in a "circulation" position. The "circulation" position is similar to the "run in" position. However, the collet assembly 52 can been displaced, so that a flow path is created between the circulation ports 68, 70. The circulation seals 72 and 74 can be moved so that circulation seal 72 is on one side of the ports 68, 70 and circulation seal 74 is on the other side of ports 68, 70, allowing flow between the ports, such as from the central flow path 15.

A desired fluid, such as a proppant slurry, can flow through the central flow path 15, through the annulus 17, or a combination thereof. In general, the slurry flows downhole through the central flow path 15, through the frac port 38 of the cross-over tool 26, through the window 34 of the MS sliding sleeve 32, into the annulus 17 and down into the area of the screen 84. The slurry flow is restricted from flowing significantly uphole by the presence of the packing element 22 in the annulus 17.

The liquid portion of the slurry passes from the annulus 17 inwardly through the screen 84 to the flow paths 48*a*, 48*b*, through ports 68 and 70, through flow paths 48*c*, 48*d*, 48*e*, 48*f*, port 28, and into annulus 17.

FIG. 5 is a schematic cross-sectional side view of a portion of a tool string in a "reverse" position. The cross-over tool 26 can be raised and lowered in the well bore independently from the packer, once the packer is set and decoupled from the setting tool 18 and cross-over tool 26. In the reverse position, the cross-over tool is pulled away from the packer and the flow reversed in the central flow path 15 and annulus 17.

Importantly, the return port cover 90 becomes disengaged with the engagement surface 94 on the packer 20. In this embodiment, the return port cover is biased closed, so that the cover closes the return port 28 upon disengagement with the packer. Fluid flows in the annulus 17 through frac port 38 and up the central flow path 15 to the surface. The reverse flow assists is washing out extraneous materials above the packer and in the central flow path left during the preceding operations. Sufficient tubing movement, caused by the pressure, temperature, bouyancy, and other downhole conditions on the tubing that leads to stretching can cause unintended opening of the circulating valve means 50 by the collet head 54 and tab 60 engaging surfaces 82, 86, or any other surface engaged by downward movement. This unintentional opening is compensated by the location of the return port cover 90 relative to the return port 28. The return port cover 90 can be positioned in the tool string, so that as the work string is raised and lowered, the return port cover 90 remains relatively fixed along the tool string with respect to the port 28. Thus, the return port cover 90 can still open and close the port 28 at the appropriate time, even with tubing movement caused by the extensive length of the work string 14 in the well bore.

While the foregoing is directed to various embodiments of the present invention, other and further embodiments can be devised without departing from the basic scope thereof. For example, the present invention can be used with other well treatment operations beside fracturing, including gravel packing, acidizing, water packing, and other treatments. Further, the various methods and embodiments of the invention can be included in combination with each other to produce variations of the disclosed methods and embodiments. Discussion of singular elements can include plural elements and vice-versa. Further, the use of any numeric quantities herein, particularly regarding the claims, such as "a" or "the", includes at least such quantity and can be more. The use of a term in a singular tense is not limiting of the number of items. Any directions shown or described such as "top," "bottom," "left," "right," "upper," "lower," "down," "up," "side," and other directions and orientations are described herein for clarity in reference to the figures and are not to be limiting of the actual device or system or use of the device or system. The device or system can be used in a number of directions and orientations.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Additionally, any headings herein are for the convenience of the reader and are not intended to limit the scope of the invention.

Further, any references mentioned in the application for this patent as well as all references listed in the information disclosure originally filed with the application are hereby incorporated by reference in their entirety to the extent such may be deemed essential to support the enabling of the invention. However, to the extent statements might be considered inconsistent with the patenting of the invention, such statements are expressly not meant to be considered as made by the Applicants.

What is claimed is:

1. A method of controlling flow through a return port positioned downhole in a well, comprising:

a. providing an engagement surface on a downhole member disposed downhole in the well, which member separates an annulus into an upper annulus and a lower annulus;

b. engaging a downhole well treatment tool having a return port and a return port cover coupled thereto with the engagement surface of the downhole member to move the return port cover from a first position to a second position;

c. disengaging the well treatment tool from the engagement surface of the downhole member; and d. allowing the return port cover to move from the second position.

2. The method of claim 1, wherein the well treatment tool comprises a cross-over tool.

3. The method of claim 1, wherein the downhole member comprises a packer and the engagement surface is coupled to an uphole portion of the packer.

4. The method of claim 1, wherein the well treatment tool comprises a cross-over tool and the downhole member comprises a packer and the engagement surface is coupled to an uphole portion of the packer, further comprising:

a. lowering the cross-over tool and packer in a coupled arrangement into the well;

b. setting the packer;

c. performing a well treatment operation with a fluid flow path through the cross-over tool and at least partially through the return port with the return port cover at least partially open;

d. raising the cross-over tool from the packer to at least partially close the return port cover on the return port; and e. altering the fluid flow path through the cross-over tool.

5. The method of claim 4, wherein altering the fluid flow path comprises altering from a circulating position to a reversing position.

6. The method of claim 1, wherein the first position is at least partially closed on a return port formed in the well treatment tool and second position is at least partially open on the return port.

7. The method of claim 6, wherein allowing the return port cover to move from the second position comprises allowing the return port cover to return to the first position.

8. The method of claim 1, further comprising initially coupling the well treatment tool with the downhole member and releasing the downhole member in a set position.

9. The method of claim 1, wherein the well treatment tool is adapted for use in fracturing, gravel packing, acidizing, water packing, or a combination thereof.

10. The method of claim 1, further comprising biasing the return port cover to a closed position.

11. The method of claim 1, further comprising coupling the return port cover to the well treatment tool proximal to the return port so that the return port cover operates to at least partially close and at least partially open the return port independent of downhole conditions that induce tubing movement.

12. A well treatment tool, comprising:

a. a wall having a return port formed therethrough to establish a fluid flow path between an exterior portion and an interior portion of the well treatment tool;

b. a return port cover coupled to the tool wall proximal the return port, the return port cover having a first position and a second position, wherein one position comprises an at least partially closed position on the return port and the other position comprises an at least partially open position on the return port;

c. an engagement surface coupled to the return port cover and adapted to engage an associated engagement surface disposed downhole on a member that is not the tool for actuation of the return port cover when the surfaces engage one another.

13. The tool of claim 12, wherein the first position comprises the at least partially closed position and the first position is used during a circulating position of the well treatment tool to establish a first flow path.

14. The tool of claim 13, wherein the second position comprises the at least partially open position and the second position is used during a reversing position to establish a second flow path.

15. The tool of claim 12, wherein the well treatment tool comprises a cross-over tool.

16. The tool of claim 15, wherein the downhole member comprises a packer.

17. The tool of claim 12, wherein the return port cover is adapted to operate to at least partially close and at least partially open the return port independent of downhole conditions that induce tubing movement.

18. A system for affecting flow through a port, comprising:

a. a work string;

b. a tool string coupled to the work string, the tool string comprising at least the well treatment tool of claim 12; and c. a downhole member having the another engagement surface disposed downhole.

19. A system for controlling flow through a port, comprising a well treatment tool having a return port facilitating communication between an upper annulus and a lower annulus and a means for at least partially opening and partially closing the return port at selective times in a well treatment operation independent of a well treatment pressure wherein the means for at least partially opening and closing is biased to an at least partially closed position.

20. The system of claim 19, wherein the well treatment tool comprises a cross-over tool.

21. The system of claim 19, wherein the means for at least partially opening and closing the return port is adapted to engage a means for engaging the return port cover on the downhole member.

22. The system of claim 19, wherein the downhole member comprises a packer.

23. The system of claim 19, wherein the means for engaging the return port cover is disposed on the downhole member to allow the means for at least partially opening and closing the return port to be raised and lowered for disengagement and engagement with the means for engaging on the downhole member.

24. The system of claim 21, wherein the means for engaging the return port cover comprises an engagement surface coupled to the downhole member.

25. A cross-over type well treatment tool adapted to be received at least partially within a downhole assembly, which downhole assembly separates a well annulus into upper and lower sections, the tool comprising:

a body having a flow path that facilitates communication between the lower annulus and the upper annulus; and a flow path restriction coupled to the tool and having an actuation surface adapted to contact a corresponding actuating surface on the downhole assembly to thereby actuate the restriction to a substantially non-flow restricting position, the restriction biased to a flow-restricting position when the actuation and actuating surfaces are displaced one from another.

26. The tool of claim 25, wherein the downhole assembly comprises a packer assembly.

27. The tool of claim 26, wherein the restriction is not actuatable by well treatment pressure.

28. The tool of claim 27, wherein the restriction is disposed in the upper annulus when the restriction is in the non-flow restricting position.

29. The tool of claim 28, wherein the flow-restricting position does not seal the flow path.

* * * * *